US009569926B2

(12) United States Patent
Acres

(10) Patent No.: US 9,569,926 B2
(45) Date of Patent: Feb. 14, 2017

(54) DISCOUNTED CREDITS AS INCENTIVE TO PLAY GAMING DEVICES

(71) Applicant: Patent Investment & Licensing Company, Las Vegas, NV (US)

(72) Inventor: John F. Acres, Las Vegas, NV (US)

(73) Assignee: PATENT INVESTMENT & LICENSING COMPANY, Las Vegas, NV (US)

( * ) Notice: Subject to any disclaimer, the term of this patent is extended or adjusted under 35 U.S.C. 154(b) by 736 days.

(21) Appl. No.: 13/668,595

(22) Filed: Nov. 5, 2012

(65) Prior Publication Data

US 2013/0310152 A1 Nov. 21, 2013

Related U.S. Application Data

(60) Provisional application No. 61/556,624, filed on Nov. 7, 2011.

(51) Int. Cl.
*G07F 17/32* (2006.01)

(52) U.S. Cl.
CPC ..... *G07F 17/3244* (2013.01); *G07F 17/3255* (2013.01)

(58) Field of Classification Search
CPC ..... G07F 17/3244; G07F 17/3255; G07F 17/3262; G07F 17/3267; G07F 17/3251; G07F 17/3258; G07F 17/323; G07F 17/3237; G07F 17/3239
See application file for complete search history.

(56) References Cited

U.S. PATENT DOCUMENTS

| | | | | | |
|---|---|---|---|---|---|
| 5,393,061 | A * | 2/1995 | Manship et al. | 463/20 |
| 5,697,843 | A * | 12/1997 | Manship et al. | 463/20 |
| 5,996,997 | A * | 12/1999 | Kamille | 273/139 |
| 6,001,016 | A * | 12/1999 | Walker et al. | 463/42 |
| 6,319,125 | B1 * | 11/2001 | Acres | 463/25 |
| 6,371,852 | B1 * | 4/2002 | Acres | 463/25 |
| 6,558,255 | B2 * | 5/2003 | Walker et al. | 463/25 |
| 6,575,832 | B1 * | 6/2003 | Manfredi et al. | 463/25 |
| 6,607,441 | B1 * | 8/2003 | Acres | 463/25 |
| 6,712,697 | B2 * | 3/2004 | Acres | 463/25 |
| 6,997,807 | B2 * | 2/2006 | Weiss | 463/25 |
| 7,086,947 | B2 * | 8/2006 | Walker et al. | 463/25 |
| 7,458,892 | B2 * | 12/2008 | Walker et al. | 463/25 |
| 7,722,458 | B2 * | 5/2010 | Walker et al. | 463/25 |
| 7,780,527 | B2 * | 8/2010 | Gauselmann | 463/30 |
| 2001/0044337 | A1 * | 11/2001 | Rowe | A63F 13/12 463/29 |

* cited by examiner

*Primary Examiner* — Werner Garner
*Assistant Examiner* — Matthew D. Hoel
(74) *Attorney, Agent, or Firm* — Marger Johnson

(57) ABSTRACT

In the present embodiments, offering credits for gaming machine play in excess of the cash used to purchase the credits may incentivize various player behaviors. Such behaviors may include remote enrollment in the player-tracking system—and payment for the credits—via a web browser; wagering a minimum amount; and wagering within a predefined time period.

12 Claims, 6 Drawing Sheets

DISCOUNTED CREDITS AS INCENTIVE TO PLAY GAMING DEVICES

BACKGROUND

This disclosure relates generally to gaming devices and more particularly to incentives offered by a proprietor of a gaming establishment to induce enrolment in a player-tracking system and play of the gaming devices.

Use of a web browser to permit off-site enrollment of players in a player-tracking system via a web browser is known in the prior art. Manual promotions in which players pay, e.g., $20 cash for $40 credit are also known.

In these prior art promotions an attendant oversees a desk associated with a bank of gaming machines dedicated to the promotion. The attendant receives cash from the player, and, using controls at the desk, applies those credits to a specified machine, which the player must play until the session ends—typically either as a result of playing all the credits or hitting a large jackpot. This is so because the $40 credit cannot be cashed out, and can be used only to play the specified gaming machine. In addition, only the top 3 awards can be cashed out; all smaller awards are applied to the gaming machine as non-cashable credits that can only be wagered.

DETAILED DESCRIPTION

Figure 1A:
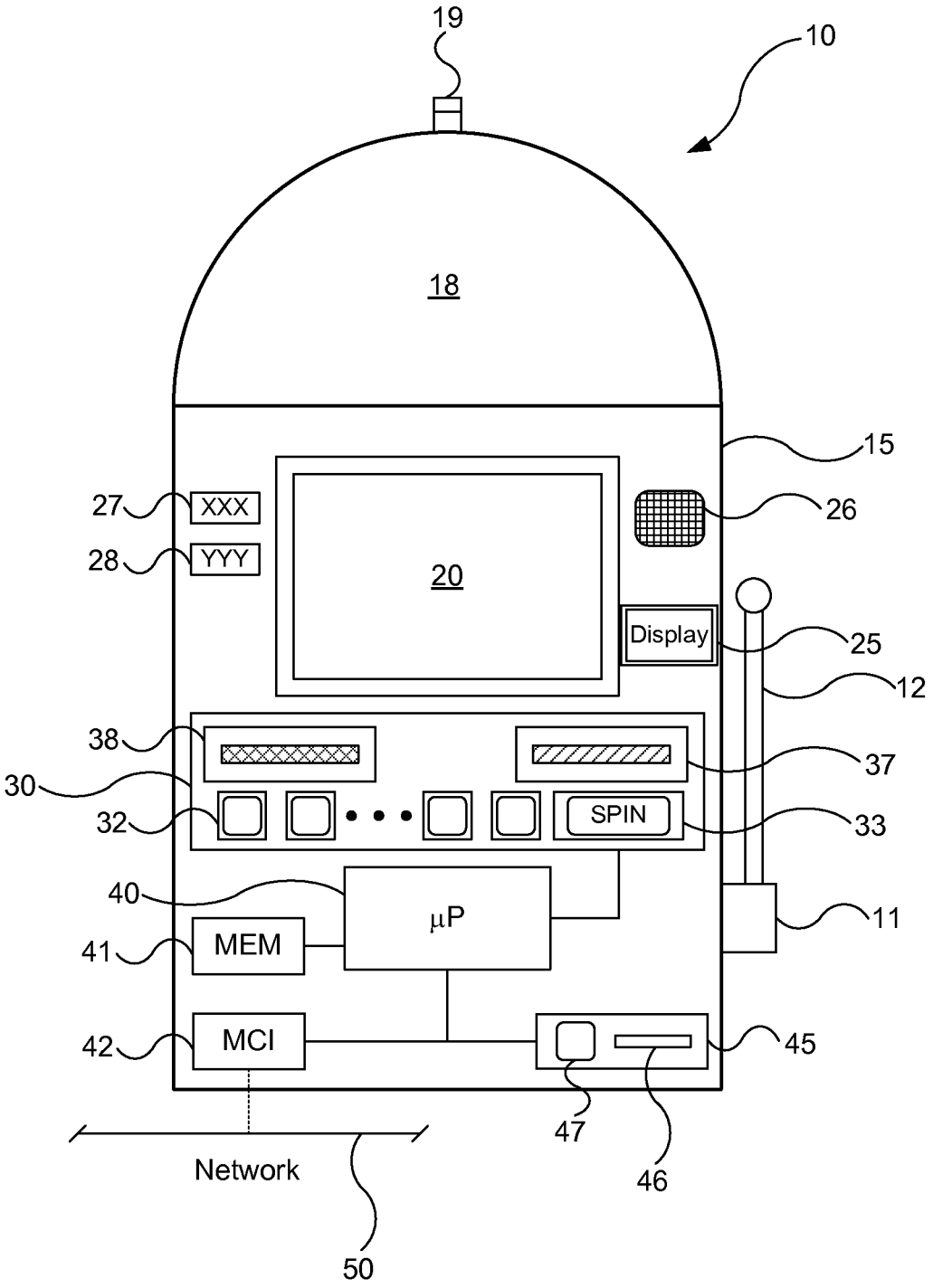
FIG. 1A is a functional block diagram that illustrates a gaming device according to embodiments of the invention.
Figure 1B:
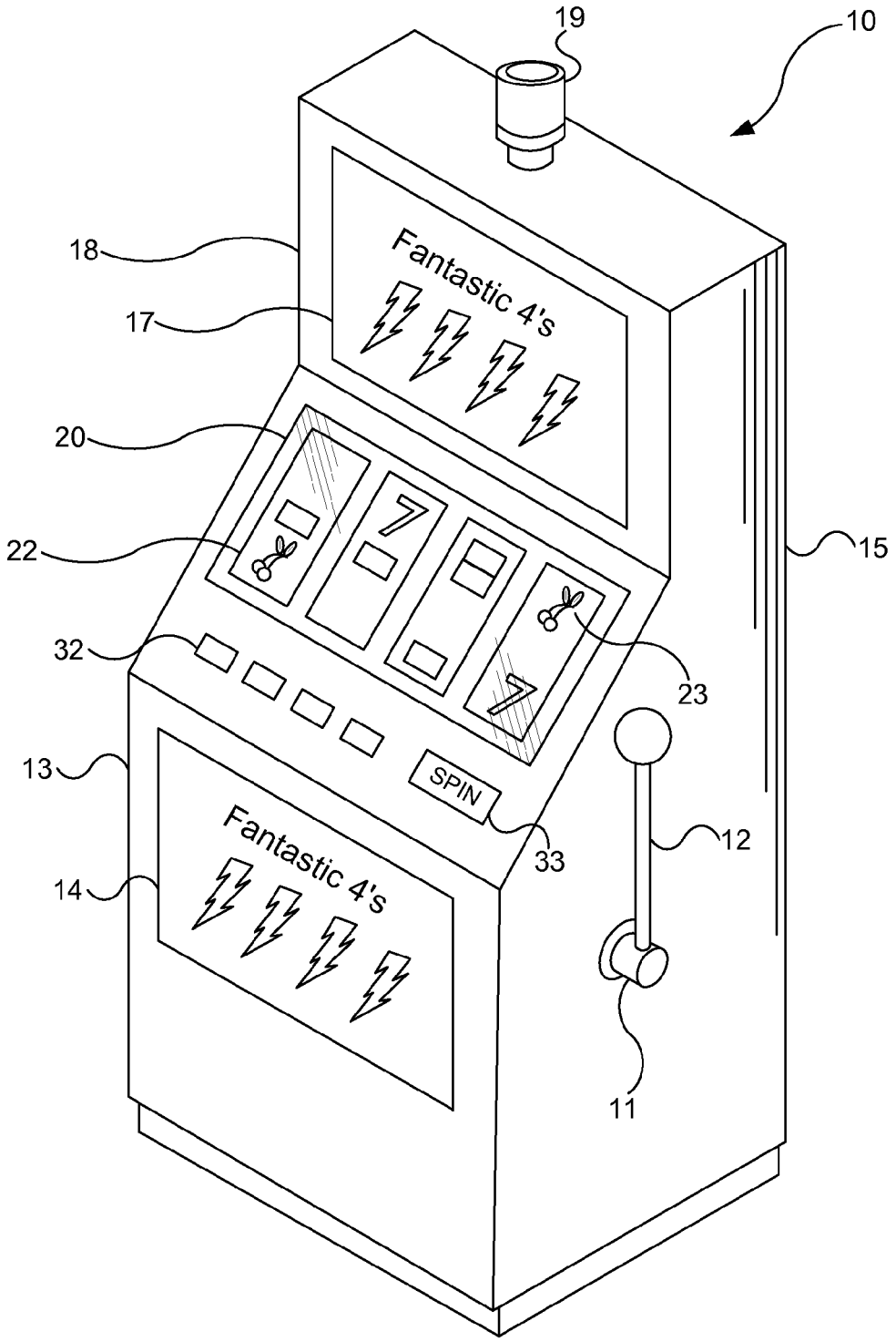
FIG. 1B is an isometric view of the gaming device illustrated in FIG. 1A.

FIGS. 1A and 1B illustrate example gaming devices according to embodiments of the invention.

Referring to FIGS. 1A and 1B, a gaming device 10 is an electronic gaming machine. Although an electronic gaming machine or "slot" machine is illustrated, various other types of devices may be used to wager monetarily based credits on a game of chance in accordance with principles of the invention. The term "electronic gaming device" is meant to include various devices such as electro-mechanical spinning-reel type slot machines, video slot machines, and video poker machines, for instance. Other gaming devices may include computer-based gaming machines, wireless gaming devices, multi-player gaming stations, modified personal electronic gaming devices (such as cell phones), personal computers, server-based gaming terminals, and other similar devices. Although embodiments of the invention will work with all of the gaming types mentioned, for ease of illustration the present embodiments will be described in reference to the electronic gaming machine 10 shown in FIGS. 1A and 1B.

The gaming device 10 includes a cabinet 15 housing components to operate the gaming device 10. The cabinet 15 may include a gaming display 20, a base portion 13, a top box 18, and a player interface panel 30. The gaming display 20 may include mechanical spinning reels (FIG. 2A), a video display (FIGS. 2B and 2C), or a combination of both spinning reels and a video display (not shown). The gaming cabinet 15 may also include a credit meter 27 and a coin-in or bet meter 28. The credit meter 27 may indicate the total number of credits remaining on the gaming device 10 that are eligible to be wagered. In some embodiments, the credit meter 27 may reflect a monetary unit, such as dollars. However, it is often preferable to have the credit meter 27 reflect a number of 'credits,' rather than a monetary unit. The bet meter 28 may indicate the amount of credits to be wagered on a particular game. Thus, for each game, the player transfers the amount that he or she wants to wager from the credit meter 27 to the bet meter 28. In some embodiments, various other meters may be present, such as meters reflecting amounts won, amounts paid, or the like. In embodiments where the gaming display 20 is a video monitor, the information indicated on the credit meters may be shown on the gaming display itself 20 (FIG. 2B). The base portion 13 may include a lighted panel 14, a coin return (not shown), and a gaming handle 12 operable on a partially rotating pivot joint 11. The game handle 12 is traditionally included on mechanical spinning-reel games, where the handle may be pulled toward a player to initiate the spinning of reels 22 after placement of a wager. The top box 18 may include a lighted panel 17, a video display (such as an LCD monitor), a mechanical bonus device (not shown), and a candle light indicator 19. The player interface panel 30 may include various devices so that a player can interact with the gaming device 10.

The player interface panel 30 may include one or more game buttons 32 that can be actuated by the player to cause the gaming device 10 to perform a specific action. For example, some of the game buttons 32 may cause the gaming device 10 to bet a credit to be wagered during the next game, change the number of lines being played on a multi-line game, cash out the credits remaining on the gaming device (as indicated on the credit meter 27), or request assistance from casino personnel, such as by lighting the candle 19. In addition, the player interface panel 30 may include one or more game actuating buttons 33. The game actuating buttons 33 may initiate a game with a pre-specified amount of credits. On some gaming devices 10 a "Max Bet" game actuating button 33 may be included that places the maximum credit wager on a game and initiates the game. The player interface panel 30 may further include a bill acceptor 37 and a ticket printer 38. The bill acceptor 37 may accept and validate paper money or previously printed tickets with a credit balance. The ticket printer 38 may print out tickets reflecting the balance of the credits that remain on the gaming device 10 when a player cashes out by pressing one of the game buttons 32 programmed to cause a 'cash-out.' These tickets may be inserted into other gaming machines or redeemed at a cashier station or kiosk for cash.

The gaming device 10 may also include one or more speakers 26 to transmit auditory information or sounds to the player. The auditory information may include specific sounds associated with particular events that occur during game play on the gaming device 10. For example, a particularly festive sound may be played during a large win or when a bonus is triggered. The speakers 26 may also transmit "attract" sounds to entice nearby players when the game is not currently being played.

The gaming device 10 may further include a secondary display 25. This secondary display 25 may be a vacuum fluorescent display (VFD), a liquid crystal display (LCD), a cathode ray tube (CRT), a plasma screen, or the like. The secondary display 25 may show any combination of primary game information and ancillary information to the player. For example, the secondary display 25 may show player tracking information, secondary bonus information, advertisements, or player selectable game options.

The gaming device 10 may include a separate information window (not shown) dedicated to supplying any combination of information related to primary game play, secondary bonus information, player tracking information, secondary bonus information, advertisements or player selectable game options. This window may be fixed in size and location or may have its size and location vary temporally as communication needs change. One example of such a resizable window is International Game Technology's "service window". Another example is Las Vegas Gaming Incorporated's retrofit technology which allows information to be placed over areas of the game or the secondary display screen at various times and in various situations.

The gaming device 10 includes a microprocessor 40 that controls operation of the gaming device 10. If the gaming device 10 is a standalone gaming device, the microprocessor 40 may control virtually all of the operations of the gaming devices and attached equipment, such as operating game logic stored in memory (not shown) as firmware, controlling the display 20 to represent the outcome of a game, communicating with the other peripheral devices (such as the bill acceptor 37), and orchestrating the lighting and sound emanating from the gaming device 10. In other embodiments where the gaming device 10 is coupled to a network 50, as described below, the microprocessor 40 may have different tasks depending on the setup and function of the gaming device. For example, the microprocessor 40 may be responsible for running the base game of the gaming device and executing instructions received over the network 50 from a bonus server or player tracking server. In a server-based gaming setup, the microprocessor 40 may act as a terminal to execute instructions from a remote server that is running game play on the gaming device.

The microprocessor 40 may be coupled to a machine communication interface (MCI) 42 that connects the gaming device 10 to a gaming network 50. The MCI 42 may be coupled to the microprocessor 40 through a serial connection, a parallel connection, an optical connection, or in some cases a wireless connection. The gaming device 10 may include memory 41 (MEM), such as a random access memory (RAM), coupled to the microprocessor 40 and which can be used to store gaming information, such as storing total coin-in statistics about a present or past gaming session, which can be communicated to a remote server or database through the MCI 42. The MCI 42 may also facilitate communication between the network 50 and the secondary display 25 or a player tracking unit 45 housed in the gaming cabinet 15.

The player tracking unit 45 may include an identification device 46 and one or more buttons 47 associated with the player tracking unit 45. The identification device 46 serves to identify a player, by, for example, reading a player-tracking device, such as a player tracking card that is issued by the casino to individual players who choose to have such a card. The identification device 46 may instead, or additionally, identify players through other methods. Player tracking systems using player tracking cards and card readers 46 are known in the art. Briefly summarizing such a system, a player registers with the casino prior to commencing gaming. The casino issues a unique player-tracking card to the player and opens a corresponding player account that is stored on a server or host computer, described below with reference to FIG. 3. The player account may include the player's name and mailing address and other information of interest to the casino in connection with marketing efforts. Prior to playing one of the gaming devices in the casino, the player inserts the player tracking card into the identification device 46 thus permitting the casino to track player activity, such as amounts wagered, credits won, and rate of play.

To induce the player to use the card and be an identified player, the casino may award each player points proportional to the money or credits wagered by the player. Players typically accrue points at a rate related to the amount wagered, although other factors may cause the casino to award the player various amounts. The points may be displayed on the secondary display 25 or using other methods. In conventional player tracking systems, the player may take his or her card to a special desk in the casino where a casino employee scans the card to determine how many accrued points are in the player's account. The player may redeem points for selected merchandise, meals in casino restaurants, or the like, which each have assigned point values. In some player tracking systems, the player may use the secondary display 25 to access their player tracking account, such as to check a total number of points, redeem points for various services, make changes to their account, or download promotional credits to the gaming device 10. In other embodiments, the identification device 46 may read other identifying cards (such as driver licenses, credit cards, etc.) to identify a player and match them to a corresponding player tracking account. Although FIG. 1A shows the player tracking unit 45 with a card reader as the identification device 46, other embodiments may include a player tracking unit 45 with a biometric scanner, PIN code acceptor, or other methods of identifying a player to pair the player with their player tracking account.

During typical play on a gaming device 10, a player plays a game by placing a wager and then initiating a gaming session. The player may initially insert monetary bills or previously printed tickets with a credit value into the bill acceptor 37. The player may also put coins into a coin acceptor (not shown) or a credit, debit or casino account card into a card reader/authorizer (not shown). In other embodiments, stored player points or special 'bonus points' awarded to the player or accumulated and/or stored in a player account may be able to be substituted at or transferred to the gaming device 10 for credits or other value. For example, a player may convert stored loyalty points to credits or transfer funds from his bank account, credit card, casino account or other source of funding. The selected source of funding may be selected by the player at time of transfer, determined by the casino at the time of transfer or occur automatically according to a predefined selection process. One of skill in the art will readily see that this invention is useful with all gambling devices, regardless of the manner in which wager value-input is accomplished.

The credit meter 27 displays the numeric credit value of the money or other value inserted, transferred, or stored dependent on the denomination of the gaming device 10. That is, if the gaming device 10 is a nickel slot machine and a $20 bill inserted into the bill acceptor 37, the credit meter will reflect 400 credits or one credit for each nickel of the inserted twenty dollars. For gaming devices 10 that support multiple denominations, the credit meter 27 will reflect the amount of credits relative to the denomination selected. Thus, in the above example, if a penny denomination is selected after the $20 is inserted the credit meter will change from 400 credits to 2000 credits.

A wager may be placed by pushing one or more of the game buttons 32, which may be reflected on the bet meter 28. That is, the player can generally depress a "bet one" button (one of the buttons on the player interface panel 30, such as 32), which transfers one credit from the credit meter 27 to the bet meter 28. Each time the button 32 is depressed an additional single credit transfers to the bet meter 28 up to a maximum bet that can be placed on a single play of the electronic gaming device 10. The gaming session may be initiated by pulling the gaming handle 12 or depressing the spin button 33. On some gaming devices 10, a "max bet" button (another one of the buttons 32 on the player interface panel 30) may be depressed to wager the maximum number of credits supported by the gaming device 10 and initiate a gaming session.

If the gaming session does not result in any winning combination, the process of placing a wager may be repeated by the player. Alternatively, the player may cash out any remaining credits on the credit meter 27 by depressing the "cash-out" button (another button 32 on the player interface panel 30), which causes the credits on the credit meter 27 to be paid out in the form of a ticket through the ticket printer 38, or may be paid out in the form of returning coins from a coin hopper (not shown) to a coin return tray.

If instead a winning combination (win) appears on the display 20, the award corresponding to the winning combination is immediately applied to the credit meter 27. For example, if the gaming device 10 is a slot machine, a winning combination of symbols 23 may land on a played payline on reels 22. If any bonus games are initiated, the gaming device 10 may enter into a bonus mode or simply award the player with a bonus amount of credits that are applied to the credit meter 27.

Figure 2A:
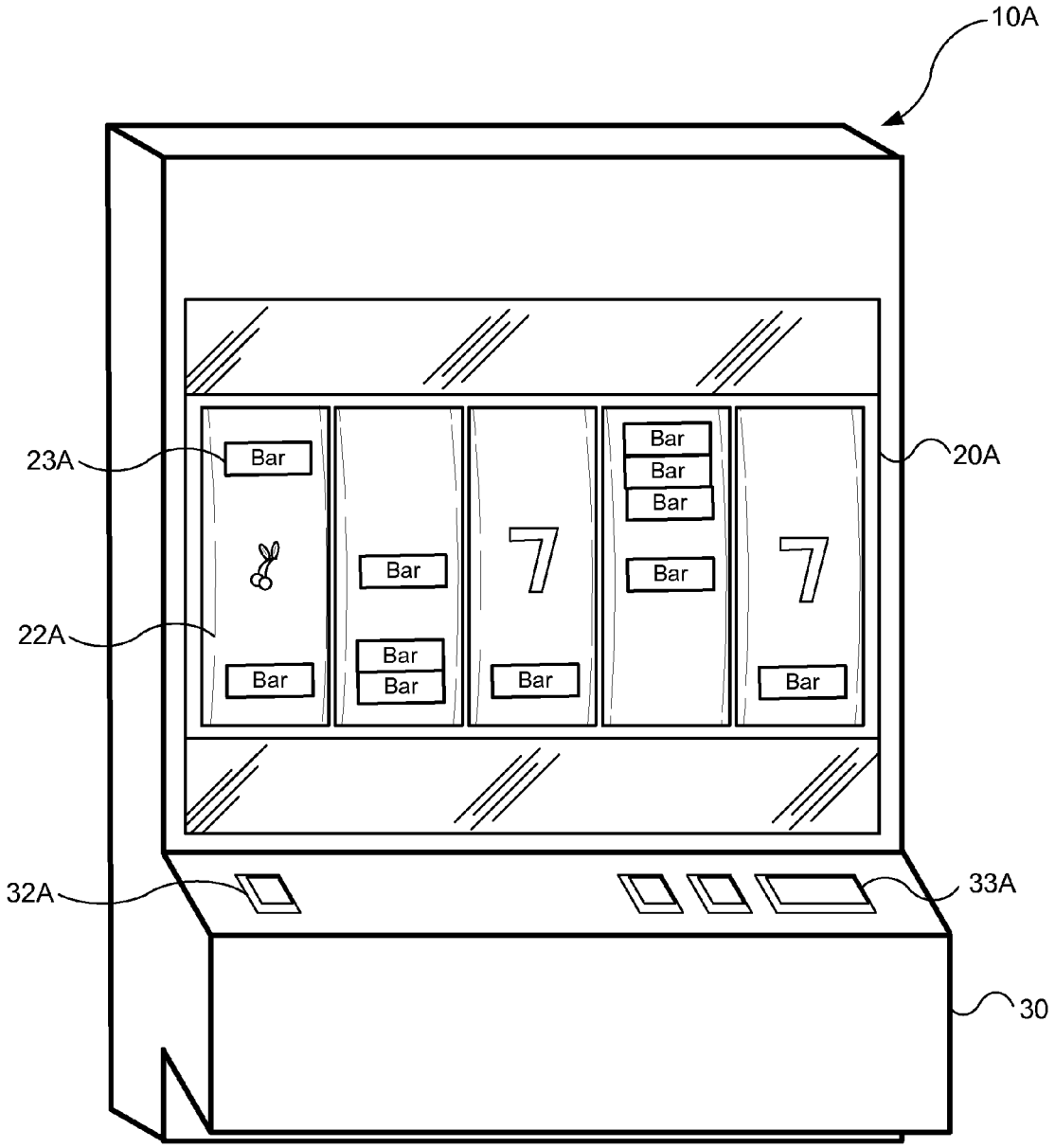
FIGS. 2A, 2B, and 2C are detail diagrams of exemplary types of gaming devices according to embodiments of the invention.
Figure 2B:
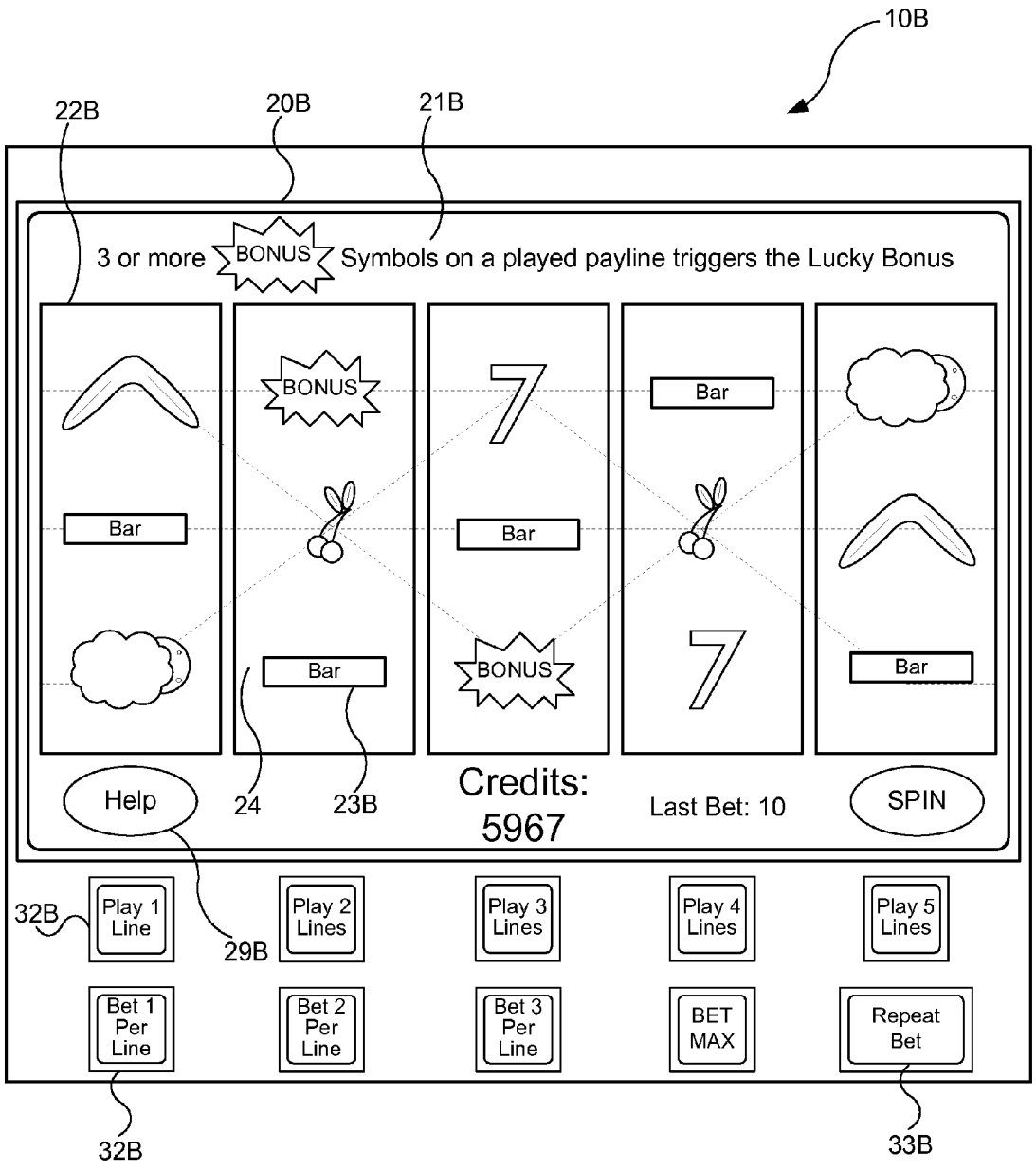
Figure 2C:
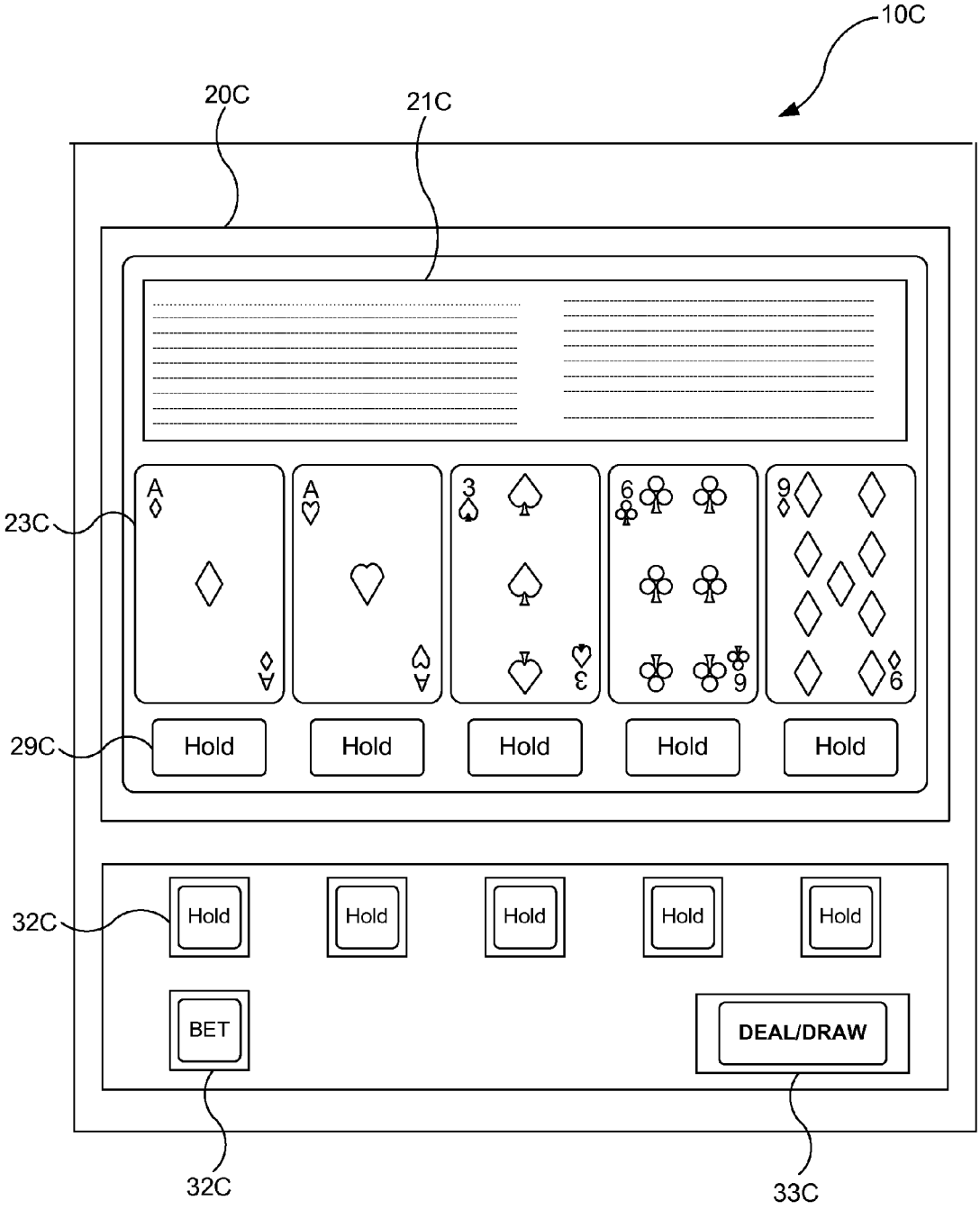

FIGS. 2A to 2C illustrate exemplary types of gaming devices according to embodiments of the invention. FIG. 2A illustrates an example spinning-reel gaming machine 10A, FIG. 2B illustrates an example video slot machine 10B, and FIG. 2C illustrates an example video poker machine 10C.

Referring to FIG. 2A, a spinning-reel gaming machine 10A includes a gaming display 20A having a plurality of mechanical spinning reels 22A. Typically, spinning-reel gaming machines 10A have three to five spinning reels 22A. Each of the spinning reels 22A has multiple symbols 23A that may be separated by blank areas on the spinning reels 22A, although the presence of blank areas typically depends on the number of reels 22A present in the gaming device 10A and the number of different symbols 23A that may appear on the spinning reels 22A. Each of the symbols 22A or blank areas makes up a "stop" on the spinning reel 22A where the reel 22A comes to rest after a spin. Although the spinning reels 22A of various games 10A may have various numbers of stops, many conventional spinning-reel gaming devices 10A have reels 22A with twenty two stops.

During game play, the spinning reels 22A may be controlled by stepper motors (not shown) under the direction of the microprocessor 40 (FIG. 1A). Thus, although the spinning-reel gaming device 10A has mechanical based spinning reels 22A, the movement of the reels themselves is electronically controlled to spin and stop. This electronic control is advantageous because it allows a virtual reel strip to be stored in the memory 41 of the gaming device 10A, where various "virtual stops" are mapped to each physical stop on the physical reel 22A. This mapping allows the gaming device 10A to establish greater awards and bonuses available to the player because of the increased number of possible combinations afforded by the virtual reel strips.

A gaming session on a spinning reel slot machine 10A typically includes the player pressing the "bet-one" button (one of the game buttons 32A) to wager a desired number of credits followed by pulling the gaming handle 12 (FIGS. 1A, 1B) or pressing the spin button 33A to spin the reels 22A. Alternatively, the player may simply press the "max-bet" button (another one of the game buttons 32A) to both wager the maximum number of credits permitted and initiate the spinning of the reels 22A. The spinning reels 22A may all stop at the same time or may individually stop one after another (typically from left to right) to build player anticipation. Because the display 20A usually cannot be physically modified, some spinning reel slot machines 10A include an electronic display screen in the top box 18 (FIG. 1B), a mechanical bonus mechanism in the top box 18, or a secondary display 25 (FIG. 1A) to execute a bonus.

Referring to FIG. 2B, a video gaming machine 10B may include a video display 20B to display virtual spinning reels 22B and various other gaming information 21B. The video display 20B may be a CRT, LCD, plasma screen, or the like. It is usually preferable that the video display 20B be a touchscreen to accept player input. A number of symbols 23A appear on each of the virtual spinning reels 22B. Although FIG. 2B shows five virtual spinning reels 22B, the flexibility of the video display 20B allows for various reel 22B and game configurations. For example, some video slot games 10B spin reels for each individual symbol position (or stop) that appears on the video display 20B. That is, each symbol position on the screen is independent of every other position during the gaming sessions. In these types of games, very large numbers of pay lines or multiple super scatter pays can be utilized since similar symbols could appear at every symbol position on the video display 20B. On the other hand, other video slot games 10B more closely resemble the mechanical spinning reel games where symbols that are vertically adjacent to each other are part of the same continuous virtual spinning reel 22B.

Because the virtual spinning reels 22B, by virtue of being computer implemented, can have almost any number of stops on a reel strip, it is much easier to have a greater variety of displayed outcomes as compared to spinning-reel slot machines 10A (FIG. 2A) that have a fixed number of physical stops on each spinning reel 22A.

With the possible increases in reel 22B numbers and configurations over the mechanical gaming device 10A, video gaming devices 10B often have multiple paylines 24 that may be played. By having more paylines 24 available to play, the player may be more likely to have a winning combination when the reels 22B stop and the gaming session ends. However, since the player typically must wager at least a minimum number of credits to enable each payline 24 to be eligible for winning, the overall odds of winning are not much different, if at all, than if the player is wagering only on a single payline. For example, in a five line game, the player may bet one credit per payline 24 and be eligible for winning symbol combinations that appear on any of the five played paylines 24. This gives a total of five credits wagered and five possible winning paylines 24. If, on the other hand, the player only wagers one credit on one payline 24, but plays five gaming sessions, the odds of winning would be identical as above: five credits wagered and five possible winning paylines 24.

Because the video display 20B can easily modify the image output by the video display 20B, bonuses, such as second screen bonuses are relatively easy to award on the video slot game 10B. That is, if a bonus is triggered during game play, the video display 20B may simply store the resulting screen shot in memory and display a bonus sequence on the video display 20B. After the bonus sequence is completed, the video display 20B may then retrieve the previous screen shot and information from memory, and re-display that image.

Also, as mentioned above, the video display 20B may allow various other game information 21B to be displayed. For example, as shown in FIG. 2B, banner information may be displayed above the spinning reels 22B to inform the player, perhaps, which symbol combination is needed to trigger a bonus. Also, instead of providing a separate credit meter 27 (FIG. 1A) and bet meter 28, the same information can instead be displayed on the video display 20B. In addition, "soft buttons" 29B such as a "spin" button or "help/see pays" button may be built using the touch screen video display 20B. Such customization and ease of changing the image shown on the display 20B adds to the flexibility of the game 10B.

Even with the improved flexibility afforded by the video display 20B, several physical buttons 32B and 33B are usually provided on video slot machines 10B. These buttons may include game buttons 32B that allow a player to choose the number of paylines 24 he or she would like to play and the number of credits wagered on each payline 24. In addition, a max bet button (one of the game buttons 32B) allows a player to place a maximum credit wager on the maximum number of available paylines 24 and initiate a gaming session. A repeat bet or spin button 33B may also be used to initiate each gaming session when the max bet button is not used.

Referring to FIG. 2C, a video poker gaming device 10C may include a video display 20C that is physically similar to the video display 20B shown in FIG. 2B. The video display 20C may show a poker hand of five cards 23C and various other player information 21C including a paytable for various winning hands, as well as a plurality of player selectable soft buttons 29C. The video display 20C may present a poker hand of five cards 23C and various other player information 21C including a number of player selectable soft (touch-screen) buttons 29C and a paytable for various winning hands. Although the embodiment illustrated in FIG. 3C shows only one hand of poker on the video display 20C, various other video poker machines 10C may show several poker hands (multi-hand poker). Typically, video poker machines 10C play "draw" poker in which a player is dealt a hand of five cards, has the opportunity to hold any combination of those five cards, and then draws new cards to replace the discarded ones. All pays are usually given for winning combinations resulting from the final hand, although some video poker games 10C may give bonus credits for certain combinations received on the first hand before the draw. In the example shown in FIG. 2C a player has been dealt two aces, a three, a six, and a nine. The video poker game 10C may provide a bonus or payout for the player having been dealt the pair of aces, even before the player decides what to discard in the draw. Since pairs, three of a kind, etc. are typically needed for wins, a player would likely hold the two aces that have been dealt and draw three cards to replace the three, six, and nine in the hope of receiving additional aces or other cards leading to a winning combination with a higher award amount. After the draw and revealing of the final hand, the video poker game 10C typically awards any credits won to the credit meter. The player selectable soft buttons 29C appearing on the screen respectively correspond to each card on the video display 20C. These soft buttons 29C allow players to select specific cards on the video display 20C such that the card corresponding to the selected soft button is "held" before the draw. Typically, video poker machines 10C also include physical game buttons 32C that correspond to the cards in the hand and may be selected to hold a corresponding card. A deal/draw button 33C may also be included to initiate a gaming session after credits have been wagered (with a bet button 32C, for example) and to draw any cards not held after the first hand is displayed.

Although examples of a spinning reel slot machine 10A, a video slot machine 10B, and a video poker machine 10C have been illustrated in FIGS. 2A-2C, gaming machines and various other types of gaming devices known in the art are contemplated and are within the scope of the invention.

Figure 3:
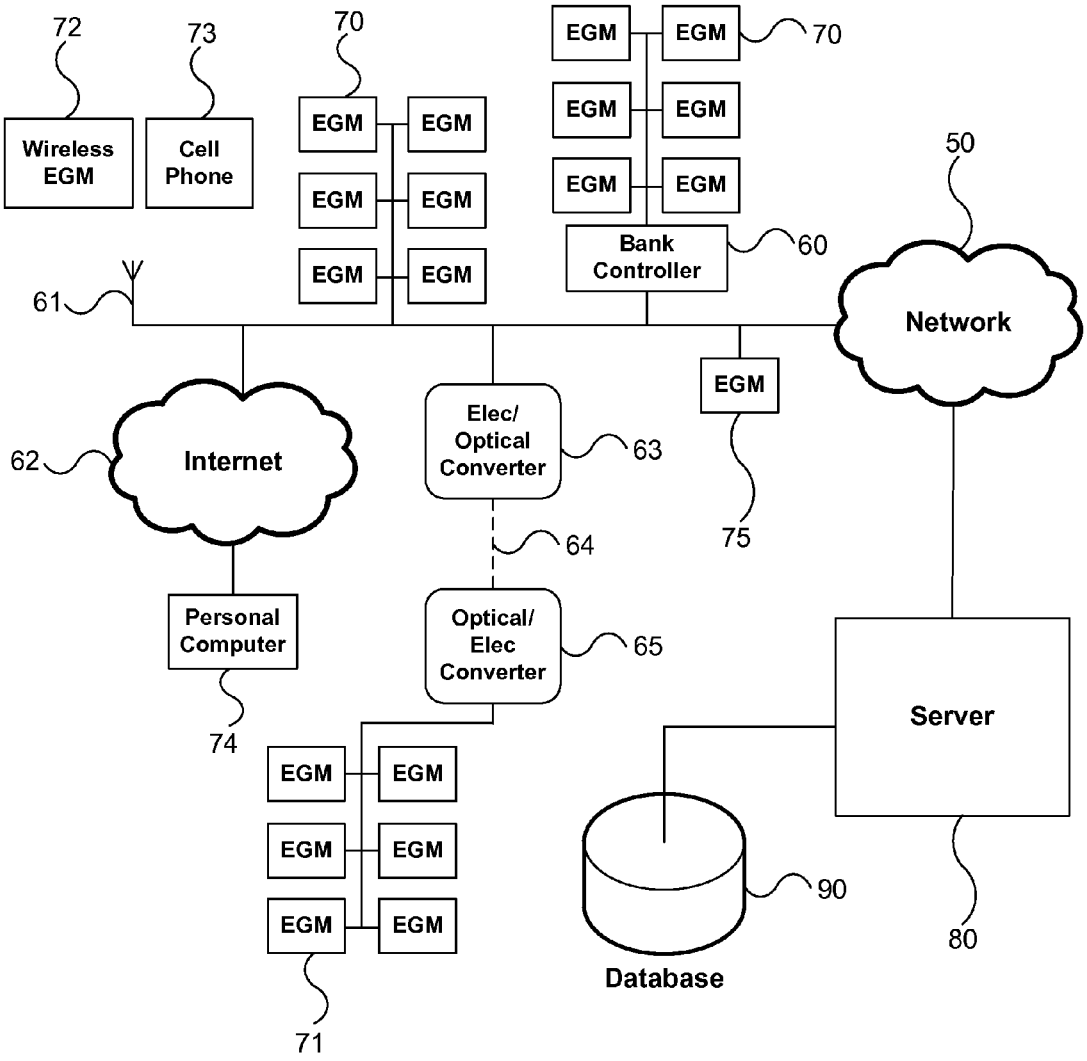
FIG. 3 is a functional block diagram of networked gaming devices according to embodiments of the invention.

FIG. 3 is a block diagram illustrating networked gaming devices according to embodiments of the invention. Referring to FIG. 3, multiple electronic gaming devices (EGMs) 70, 71, 72, 73, 74, and 75 may be coupled to one another and coupled to a remote server 80 through a network 50. For ease of understanding, gaming devices or EGMs 70, 71, 72, 73, 74, and 75 are generically referred to as EGMs 70-75. The term EGMs 70-75, however, may refer to any combination of one or more of EGMs 70, 71, 72, 73, 74, and 75. Additionally, the gaming server 80 may be coupled to one or more gaming databases 90. These gaming network 50 connections may allow multiple gaming devices 70-75 to remain in communication with one another during particular gaming modes such as tournament play or remote head-to-head play. Although some of the gaming devices 70-75 coupled on the gaming network 50 may resemble the gaming devices 10, 10A, 10B, and 10C shown in FIGS. 1A-1B and 2A-2C, other coupled gaming devices 70-75 may include differently configured gaming devices. For example, the gaming devices 70-75 may include traditional slot machines 75 directly coupled to the network 50, banks of gaming devices 70 coupled to the network 50, banks of gaming devices 70 coupled to the network through a bank controller 60, wireless handheld gaming machines 72 and cell phones 73 coupled to the gaming network 50 through one or more wireless routers or antennas 61, personal computers 74 coupled to the network 50 through the internet 62, and banks of gaming devices 71 coupled to the network through one or more optical connection lines 64. Additionally, some of the traditional gaming devices 70, 71, and 75 may include electronic gaming tables, multi-station gaming devices, or electronic components operating in conjunction with non-gaming components, such as automatic card readers, chip readers, and chip counters, for example.

Gaming devices 71 coupled over an optical line 64 may be remote gaming devices in a different location or casino. The optical line 64 may be coupled to the gaming network 50 through an electronic to optical signal converter 63 and may be coupled to the gaming devices 71 through an optical to electronic signal converter 65. The banks of gaming devices 70 coupled to the network 50 may be coupled through a bank controller 60 for compatibility purposes, for local organization and control, or for signal buffering purposes. The network 50 may include serial or parallel signal transmission lines and carry data in accordance with data transfer protocols such as Ethernet transmission lines, Rs-232 lines, firewire lines, USB lines, or other communication protocols. Although not shown in FIG. 3, substantially the entire network 50 may be made of fiber optic lines or may be a wireless network utilizing a wireless protocol such as IEEE 802.11 a, b, g, or n, Zigbee, RF protocols, optical transmission, near-field transmission, or the like.

As mentioned above, each gaming device 70-75 may have an individual processor 40 (FIG. 1A) and memory 41 to run and control game play on the gaming device 70-75, or some of the gaming devices 70-75 may be terminals that are run by a remote server 80 in a server based gaming environment. Server based gaming environments may be advantageous to casinos by allowing fast downloading of particular game types or themes based on casino preference or player selection. Additionally, tournament based games, linked games, and certain game types, such as BINGO or keno may benefit from at least some server 80 based control. Thus, in some embodiments, the network 50, server 80, and database 90 may be dedicated to communications regarding specific game or tournament play. In other embodiments, however, the network 50, server 80, and database 90 may be part of a player tracking network. For player tracking capabilities, when a player inserts a player tracking card in the card reader 46 (FIG. 1A), the player tracking unit 45 sends player identification information obtained on the card reader 46 through the MCI 42 over the network 50 to the player tracking server 80, where the player identification information is compared to player information records in the player database 90 to provide the player with information regarding their player account or other features at the gaming device 10 where the player is wagering. Additionally, multiple databases 90 and/or servers 80 may be present and coupled to one or more networks 50 to provide a variety of gaming services, such as both game/tournament data and player tracking data.

The various systems described with reference to FIGS. 1-3 can be used in a number of ways. For instance, the systems can be used to track data about various players. The tracked data can be used by the casino to provide additional benefits to players, such as extra bonuses or extra benefits such as bonus games and other benefits as described above. These added benefits further entice the players to play at the casino that provides the benefits.

As noted above, it is desirable for players to be enrolled in the player-tracking system. This is typically done at the casino through a casino employee who is responsible for registering players in the system. This is typically done at a terminal where the player's identifying information is entered and a card is issued to the player. Of course there are other ways to identify the player to the system, but a card will be used in this embodiment.

Cashless play is known in the prior art. One way of implementing cashless play is to receive a deposit from a player and open an account reflecting the amount deposited. The account may be stored in or associated with the player's player-tracking account. When the player is identified at one of the gaming machines, like EGM 70, credits may be transferred via network 50 from the player account to the credit meter of the gaming machine. Also known are promotional credits, which are typically given to a player as an incentive. These credits can be played but they cannot be cashed out. Using similar techniques, cashing out winnings reflected on another meter of the gaming device may be prevented or limited to achieve the objectives of this embodiment.

Description will now be made of an incentive that a casino could offer consistent with the present development.

One way of inducing off-site enrollment is to offer discounted credits. For example, as shown in the first row of the table below, if the player signs up via a browser and commits $100 via an online payment, e.g., credit card, bank transfer, etc., he or she will receive $110 in playable credits. Once the player is enrolled via a web browser, a card or other identifying device may be mailed to the player. Or the player may pick it up on arrival to the casino. In any event, once the player is identified to the player tracking system, the player is given access to the credits acquired, in this case, $110. This may be an automatic transfer from the account or in response to a command issued by the player at the gaming machine or via an associated player interface with network 50.

Once the credits are so applied to the credit meter, the player can play them or cash them out along with whatever winnings might result from the play. This arrangement produces a newly enrolled player in the casino and at a game ready to play—without requiring casino personnel to enroll the player.

Another embodiment is depicted on row 2 of the table. In this embodiment, the player may sign up at the casino or via the browser. The player would typically acquire more credits by doing so via a web browser. In any event, in this embodiment, the credits acquired cannot be cashed out; they can only be played. Any jackpot awards, however, that result from play with these credits may be cashed out.

In the third row, another embodiment is illustrated in which the player receives $140. It is higher because in this version, the player cannot cashout any credits until after he or she has wagered a total of $300. There is some chance that the player will run out of money before wagering the full $300, but most likely the reinvested winnings will see the player through to the $300 at which time any remaining funds on the credit meter may be cashed out.

In the fourth row, the player acquires $300 because the cashout is restricted to the top award. In other words, the player will always play until all the money is gone, but if the top jackpot is hit before the money is gone, the top jackpot can be cashed out. Lower awards are paid to the credit meter as credits that cannot be cashed out, only played. Alternatively, instead of restricting the ability to cash out only the top award, players may cash out the top X number of awards. These features are appealing to players who like to play for big jackpots and would be willing to receive a substantial discount on credits in exchange for being limited to cashing out the top jackpot or the top X number of jackpots.

In the fifth row, the player acquires $150 if the credits paid for by the player are played within a predefined time period. For example, the paid credits may need to be played within any 24-hour period, within X hours from purchase, on a specified weekday, between specified hours of the day, anytime but a weekend, so long as play does not start until after a predefined date or time, or any other defined time frame.

Receiving the increased credits may further be conditioned on playing any of the paid-for credits within the predefined time period, playing all of the credits with the predefined time period, or playing a minimum amount within the predefined time period.

In this feature, the player tracking system, which records the date and time of wagers, tracks play by the player to determine whether play has occurred within the predefined time period, which might be referenced to the time of purchase of credits or only to a calendar and clock, or to a combination of those. And the player-tracking system also tracks amounts played if that is also a criteria to receiving additional credits.

If and when the player-tracking system determines that the predefined criterion or criteria is met, the player-tracking system credits the player account with additional credits that may be wagered. As with the other approaches, these credits may not be cashed out, and additional credits may be awarded if the player created the record and purchase of credits using a kiosk or his or her computing device.

In one embodiment of this feature, the player is notified that credits are added if play is achieved within the predefined time period and/or in the amounts required to receive additional credits. This provides the gaming establishment where the games are played with incentives to spur play during times when play is traditionally slow, and can also be used to provide incentive for the purchaser to compress the time in which he or she plays the credits. The player may be notified of the rules for increasing credits in the account when the credits are purchased—either just before or just after. Such notification can occur via a screen interface or in a poster or the like associated with a kiosk or player club desk where the purchase takes place.

Alternatively, the additional credits may be added at the time of purchase, but may not be cashed out unless play within the predefined time period is met. In a still further variation, the purchased credits may not be cashed out, but awards, either all or at specified levels, may be cashed out if play within the predefined time period is met.

The foregoing discount features may also be transferrable from one person to another. For example, one person could access the network, pay for discounted credits, and receive a card, bar code, or other indicia usable to access the account in a form that could be sent to someone as a gift electronically or otherwise. In short, given as a gift card for wagering credits that are discounted to the purchaser in any of the ways described above.

Credits purchased according to this embodiment of the invention can be played on any game in the casino that is associated with a player-tracking interface and from which cashless play is implemented. The purchase may be scaled so that each category is provides a specified percentage enhancement of credits acquired for however much cash is used to purchase. In other words, if the enhancement is 20% and the player pays, e.g., $20, $40, or $45, the credits acquired are $24, $48, or $54, respectively.

Different combinations of commitment levels may be offered to the player. In addition, some may be combined. For example, if players enroll via a browser for those on the $2^{nd}$ through $4^{th}$ rows, more credits may be acquired than if the player enrolled at the casino. In addition, the promotion may be limited to certain games or types of games. This limitation may be placed in the player's account. As a result, when the system identifies the player, only the specified games may be played. The available games may be in more than one casino.

| Player Cost | Credits Acquired | Conditions |
|---|---|---|
| $100 | $110 | Enrollment via web browser |
| $100 | $120 | Only awards can be cashed out |
| $100 | $140 | Cashout only after $300 wagered |
| $100 | $300 | Cashout only if top jackpot hit |
| $100 | $150 | Play within predefined time period |

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A method for using an electronic account accessible by a computer network for playing a gaming machine on the network, the method comprising:

enrolling players in a player-tracking system;

establishing a player-tracking record for each enrolled player, each record including information that identifies a player including at least the player's name;

receiving money from an enrolled player;

providing credits to the enrolled player, the credits having a value equal to the player payment and being usable to play the gaming machine;

tracking play by an enrolled player and associating data related to the tracked play with the player's record;

permitting the player to cash out at least some of the credits in the form of a printed ticket via a printer associated with the gaming device in response to actuation of a cash-out actuator by the player;

providing a user interface usable by an un-enrolled player to self-enroll himself or herself in the player-tracking system;

receiving from the un-enrolled player information that identifies the player including at least the un-enrolled player's name responsive to operation of the user interface by the un-enrolled player;

creating a player-tracking record in an account responsive to self-enrollment by the player including the information that identifies the player;

receiving from the self-enrolled player an electronic payment for discounted credits via the user interface responsive to operation of the user interface by the un-enrolled player;

if the identifying player information has been received, providing discounted credits to the self-enrolled player, the credits having a value greater than the received payment and being usable to play the gaming machine;

associating the discounted credits with the account of the self-enrolled player;

permitting the self-enrolled player to wager at least some of the discounted credit associated with the account on at least one of the gaming machines;

crediting the self-enrolled player with award credits generated in response to play of the gaming machine with the discounted credits; and preventing the cash-out actuator from cashing out at least some of the award credits.

2. The method of claim 1 wherein the gaming machines are located in a gaming establishment and wherein the user interface comprises a computing device located remotely from the gaming establishment.

3. The method of claim 1 comprising preventing the self-enrolled player from cashing out predefined jackpots payable by the gaming machine.

4. The method of claim 3 wherein the jackpots payable by the gaming machine comprise predefined awards that sequentially increase in value and wherein preventing the self-enrolled player from cashing out predefined jackpots comprises preventing the player from cashing out a plurality of sequential award values starting with the lowest award value.

5. The method of claim 3 comprising preventing the self-enrolled player from cashing out all but the highest value jackpot award.

6. The method of claim 1 comprising preventing the self-enrolled player from cashing out the game credits until after the player has wagered a predefined amount in excess of the payment.

7. The method of claim 1 further comprising:

creating a transferrable record locator; and permitting a player to wager game credit in the account responsive to accessing the record with the record locator.

8. The method of claim 1 further comprising permitting the self-enrolled player to cash out the discounted credits.

9. A method for using an electronic account accessible by a computer network for playing a gaming machine on the network, the method comprising:

enrolling players in a player-tracking system;

establishing a player-tracking record for each enrolled player, each record including information that identifies a player, including at least the player's name;

receiving money from an enrolled player;

providing credits to the enrolled player, the credits having a value equal to the player payment and being usable to play the gaming machine;

tracking play by an enrolled player and associating data related to the tracked play with the player's record;

permitting the player to cash out at least some of the credits in the form of a printed ticket via a printer associated with the gaming device in response to actuation of a cash-out actuator by the player;

providing a user interface usable by an un-enrolled player to self-enroll himself or herself in the player-tracking system;

receiving from the un-enrolled player information that identifies the player including at least the un-enrolled player's name responsive to operation of the user interface by the un-enrolled player;

creating a player-tracking record in an account responsive to self-enrollment by the player including the information that identifies the player;

receiving from the self-enrolled player an electronic payment for discounted credits via the user interface responsive to operation of the user interface by the un-enrolled player;

if the identifying player information has been received, providing discounted credits to the self-enrolled player, the credits having a value greater than the received payment and being usable to play the gaming machine;

associating the discounted credits with the account of the self-enrolled player;

permitting the self-enrolled player to wager at least some of the discounted credit associated with the account on one of the gaming machines;

crediting the self-enrolled player with award credits generated in response to play of the gaming machine with the discounted credits;

tracking the time period in which the self-enrolled player wagers the discounted credits;

determining whether all of the discounted credits are wagered within a predetermined time period; and if not, preventing the cash-out actuator from cashing out at least some of the award credits.

10. The method of claim 9 further comprising permitting the self-enrolled player to cash out the discounted credits.

11. A method for using an electronic account accessible by a computer network for playing gaming machines on the network, the method comprising:

enrolling players in a player-tracking system;

establishing a player-tracking record for each enrolled player, each record including information that identifies a player including at least the player's name;

receiving money from an enrolled player;

providing credits to the enrolled player, the credits having a value equal to the player payment and being usable to play the gaming machine;

tracking play by an enrolled player and associating data related to the tracked play with the player's record;

permitting the player to cash out at least some of the credits in the form of a printed ticket via a printer associated with the gaming device in response to actuation of a cash-out actuator by the player;

providing a user interface via a computing device connected to a global computer network, the user interface being usable by an un-enrolled player to self-enroll himself or herself in the player-tracking system;

receiving from the un-enrolled player information that identifies the player including at least the player's name responsive to operation of the computing device by the un-enrolled player;

creating a player-tracking record in an account via the user interface, the player record including the information that identifies the player;

receiving from the self-enrolled player payment for discounted credits via the computing device responsive to operation of the computing device by the un-enrolled player;

associating the received payment with the account;

if the identifying player information has been received, associating game credits in excess of the received payment with the account responsive to receiving the player payment;

permitting the self-enrolled player to wager at least some of the associated game credits on at least one of the gaming machines;

crediting the self-enrolled player with award credits generated in response to play of the gaming machine with the discounted credits; and preventing the cash-out actuator from cashing out at least some of the award credits.

12. The method of claim 11 further comprising permitting the self-enrolled player to cash out the discounted credits.

* * * * *